US011156416B2

(12) United States Patent
Arnedo Vera et al.

(10) Patent No.: US 11,156,416 B2
(45) Date of Patent: Oct. 26, 2021

(54) SYSTEM FOR LOADING PELLETS

(71) Applicant: GAMO OUTDOOR, S.L., Sant Boi de Llobregat (ES)

(72) Inventors: Julian Arnedo Vera, Sant Boi de Llobregat (ES); Antonio Fidel Nuñez Morales, Sant Boi de Llobregat (ES)

(73) Assignee: GAMO OUTDOOR, S.L., Sant Boi de Llobregat (ES)

( * ) Notice: Subject to any disclaimer, the term of this patent is extended or adjusted under 35 U.S.C. 154(b) by 0 days.

(21) Appl. No.: 16/627,521

(22) PCT Filed: Jun. 8, 2018

(86) PCT No.: PCT/ES2018/070417
§ 371 (c)(1),
(2) Date: Dec. 30, 2019

(87) PCT Pub. No.: WO2019/234264
PCT Pub. Date: Dec. 12, 2019

(65) Prior Publication Data

US 2021/0080203 A1 Mar. 18, 2021

(51) Int. Cl.

| | |
|---|---|
| ***F41B 11/00*** | (2013.01) |
| ***F41A 9/45*** | (2006.01) |
| ***F41B 11/50*** | (2013.01) |
| ***F41B 11/648*** | (2013.01) |
| ***F41B 11/54*** | (2013.01) |

(52) U.S. Cl.
CPC ..... *F41A 9/45* (2013.01); *F41B 11/50* (2013.01); *F41B 11/54* (2013.01); *F41B 11/648* (2013.01)

(58) Field of Classification Search
CPC ..... F41B 11/50; F41B 11/54
See application file for complete search history.

(56) References Cited

U.S. PATENT DOCUMENTS

| | | | | |
|---|---|---|---|---|
| 4,986,251 | A * | 1/1991 | Lilley | F41B 11/54 124/48 |
| 4,993,400 | A * | 2/1991 | Fitzwater | F41B 11/54 124/48 |
| 5,400,536 | A * | 3/1995 | Milliman | F41A 19/53 124/74 |
| 6,470,871 | B2 * | 10/2002 | Casas-Salva | F41B 11/54 124/48 |

(Continued)

FOREIGN PATENT DOCUMENTS

| | | | | |
|---|---|---|---|---|
| DE | 102011008684 | A1 * | 9/2012 | F41B 11/54 |
| WO | WO-2017125622 | A1 * | 7/2017 | F41A 9/45 |

*Primary Examiner* — John A Ricci
(74) *Attorney, Agent, or Firm* — Patrick Stanzione; Stanzione & Associates, PLLC

(57) ABSTRACT

A system for loading pellets that includes a stock (1) on which a chamber (2) is fixed, said chamber (2) ends externally with a fork (102) wherein the barrel is articulated a barrel, the barrel (3) comprising a pellet chamber (5), a magazine (12) of pellets (13) and articulating means (4), characterized in that it comprises: a first structure (6) with central section (9) and two ends (7, 8) which is housed in fork (102) of chamber (2), a support (101) wherein the central section (9) of structure (6) with forward and reverse movement thereof is positioned, at least partially, a housing (100) for said magazine (12), and a pushing means (11), linked to the structure (6), arranged on the support (101).

20 Claims, 15 Drawing Sheets

(56) References Cited

U.S. PATENT DOCUMENTS

| | | | | |
|---|---|---|---|---|
| 6,688,298 | B2 * | 2/2004 | Maeda | F41B 11/55 124/48 |
| 9,664,475 | B1 * | 5/2017 | Maggiore | F41B 11/81 |

* cited by examiner

SYSTEM FOR LOADING PELLETS

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept relates to system for loading pellets, used in rifles with a articulated or "break barrel" type barrel, of the type comprising a stock wherein on which a chamber is fixed, said chamber ending externally with a fork wherein the barrel is articulated, the barrel comprising a pellet chamber, a pellet magazine and articulating means, characterized in that it comprises: a first structure with a central section and two ends that are housed in the fork of the chamber, a support wherein the central section of structure with forward and reverse movement thereof is positioned, at least partially, a housing for the magazine, a pushing means, linked to the structure, arranged on the support; the magazine being laid on the barrel with the barrel is closed, and the magazine being faced to the pellet chamber with the barrel at the moment of the barrel break trajectory, with a pellet that is placed in front of said pellet chamber at the end of the break trajectory.

2. Description of the Related Art

Patents are known in the state of the art to comprise systems for loading pellets for rifles with articulated barrels.

So, Patent WO2013074054 is known, from the year 2012, in the name of LUKASHEVYCH ANDRII BOGDANOVICH, which refers to an improvement to an automatic belt-fed pneumatic air gun, which is directed towards achieving a more compact cartridge arrangement in the cartridge belt, enabling the loading of the belt without the need for additional instruments, and also providing a feed mechanism for the new design of the pouch. The pistol includes a barrel, a breech, a valve stem for supplying compressed gas to the barrel bore, a firing pin to open the valve, a hammer for activating the firing pin, a bolt for seating cartridges in the barrel bore and sealing the hole, a cartridge belt, and a cartridge belt feed mechanism for moving the cartridge belt as the gun is reloaded. The cartridge belt constitutes a single component made from an elastic material and having a row of openings of a smaller diameter than the cartridges loaded into the. The cartridge belt feed mechanism comprises a slide mounted on the breech, in such a way that as to be able to move parallel to the barrel, a lever mounted above the slide, said lever being articulately connected to the breech and pressed to the slide by a spring, and a spring-loaded cartridge belt lock mounted on the end of the lever and engaging with the cartridge belt, wherein the bolt has a lateral protuberance which is disposed in a longitudinal groove in the slide.

The applicant firm is owner of Patent WO2017/125622, from the year 2016, relating to a pellet loading system, the ones used in rifles with a articulated or "break barrel" type barrel, of the type comprising a stock on which there is attached a chamber, a barrel where there is placed the pellet chamber, a pellet magazine and articulating means, characterized in that it comprises: an elastic rod with a central section and two ends that are housed in the chamber, a body where there is positioned the central section of the elastic rod with forward and reverse movement inside said body and which is attached to the barrel, and a pushing means, linked to the elastic rod and placed between the pellet to be loaded and the elastic rod, with the pushing means moving to one of the pellets in the magazine at the moment when the barrel collapses, thereby with the pushing means housing a pellet inside the pellet chamber, and with said pushing means then returning to the initial position when the barrel closes leaving the rifle loaded.

The search report of the above mentioned PCT application also quotes the following documents, although with little relevance: the German Patents DE1174653, DE102011008684 and DE826852 and the British ones GB545731 and GB1253184.

SUMMARY OF THE INVENTIVE CONCEPT

The present general inventive concept relates to the pellet loading systems in rifles with articulated barrels, even though it could also be understood to be included in any guns with an articulated barrel.

The closest document is Patent WO2017/125622.

As it was indicated in the closest document, one of the big problems at present with rifles with an articulated barrel, also called "break barrel", when they have a pellet magazine, is that when the pellets are housed in the pellet magazine, any misalignment between the barrel and the magazine can damage the pellet at the time of shooting, because the pellet, once damaged, will have an erratic trajectory once outside the barrel.

Said invention is very useful because in one of its embodiments it allows a configuration of a magazine in the form of a revolver, which facilitates loading and shooting the pellets.

This configuration is usually used with rifles that use telescopic sight, which is very common in countries like the USA.

In other countries the sportsmen prefer to use open sight (rear and front sight), such as for example, Spain, which means that using the revolver like magazines is discarded because they do not allow visual alignment of the line of fire through the magazine, from the sight.

To solve this problem the inventors have invented a system wherein, in rest position, with the rifle or air gun or CO2 gun, ready to fire, and the barrel closed, the magazine is hidden in a structure, not interfering to the view of the firing line from the sight.

To load the rifle or gun, the barrel is articulated or collapsed and meanwhile the magazine is moved towards the pellet chamber to which it lies opposite.

Subsequently, when the barrel is closed, the magazine moves towards its initial position, which is that of lying in connection with the barrel, allowing the sportsman's view and not interfering with the rear and firing line.

The pellet of the magazine is positioned inside the pellet chamber by a pushing means. Said pellet is placed in the magazine when the barrel is breaking at maximum, or a moment before or a moment after.

The foregoing and/or other features and utilities of the present general inventive concept may be achieved by providing system for loading system, used in rifles with a articulated or "break barrel" type barrel, of the type comprising a stock on which a chamber can be fixed, the chamber ending externally with a fork wherein the barrel is articulated, the barrel comprising a pellet chamber, a pellet magazine and articulating means, characterized in that the system can comprise: a first structure with a central section and two ends which are housed in the fork in the chamber, a support wherein the central section of structure with forward and reverse movement thereof is positioned, at least partially, a housing for the magazine, a pushing means, linked to the structure, arranged on the support; the magazine (12) being laid on barrel (3), with barrel (3) is closed and the magazine (12) being faced to the pellet chamber (5) with barrel (3) at the moment of the barrel break trajectory, with a pellet (13) placed in front of said pellet chamber (5) at the end of the break trajectory.

In an exemplary embodiment, when magazine (12) can be positioned in front of pellet chamber (5), pushing means (11) can be positioned in front of pellet (13) which, in turn, can be positioned in front of pellet chamber (5) and during the break movement of barrel (3), pushing means (11) can be in front of pellet (13) and said pushing means (11) insert the pellet (13) into pellet chamber (5) and then said pushing means (11) can be returned to the initial position when barrel (3) closes, the magazine (12) is returned to its lying down position and leaving the rifle loaded In another exemplary embodiment, the system can be characterized in that at the end of the breaking operation of barrel (3), pushing means (11) can be positioned in front of pellet (13), and at the moment when the barrel (3) is closing, said pushing means (11) insert the pellet (13) into the pellet chamber (5), with said pushing means (11) then returning to their initial position, and with magazine (12) returning to its lying down position, leaving the rifle loaded.

In another exemplary embodiment, the system can include a body (10) articulated to barrel (3), and in that the housing (100) for magazine (12) can be articulated to the body (10).

In another exemplary embodiment, the system can be characterized in that the housing (100) for magazine (12) can be articulated to support (101) and to body (10).

In another exemplary embodiment, the system can be characterized in that pushing means (11) can be located inside the support (101).

In another exemplary embodiment, the system can be characterized in that the support (101) can comprise guiding pins (103) which are positioned on guides (104) of the body (10) along which they are moving.

In another exemplary embodiment, the system can be characterized in that housing (100) of magazine (12), can comprise stops (105) which are positioned outside of the chamber (2) and guiding the position changing movement of magazine (12).

In another exemplary embodiment, the system can be characterized in that damping means can be comprised in the body (10).

In another exemplary embodiment, the system can be characterized in that the damping means can comprise an axis with a second spring (123) and damping guides (106).

In another exemplary embodiment, the system can be characterized in that the support (101) can be articulated to housing (100) and to body (10).

In another exemplary embodiment, the system can be characterized in that a second structure (107) can be connected to support (101) and to body (10) and coordinated with first structure (6).

In another exemplary embodiment, the system can be characterized in that at least the first structure (6) or second structure (107) is a rod.

In another exemplary embodiment, the system can be characterized in that rod (107) is elastic.

Additional features and utilities of the present general inventive concept will be set forth in part in the description which follows and, in part, will be obvious from the description, or may be learned by practice of the general inventive concept.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1:
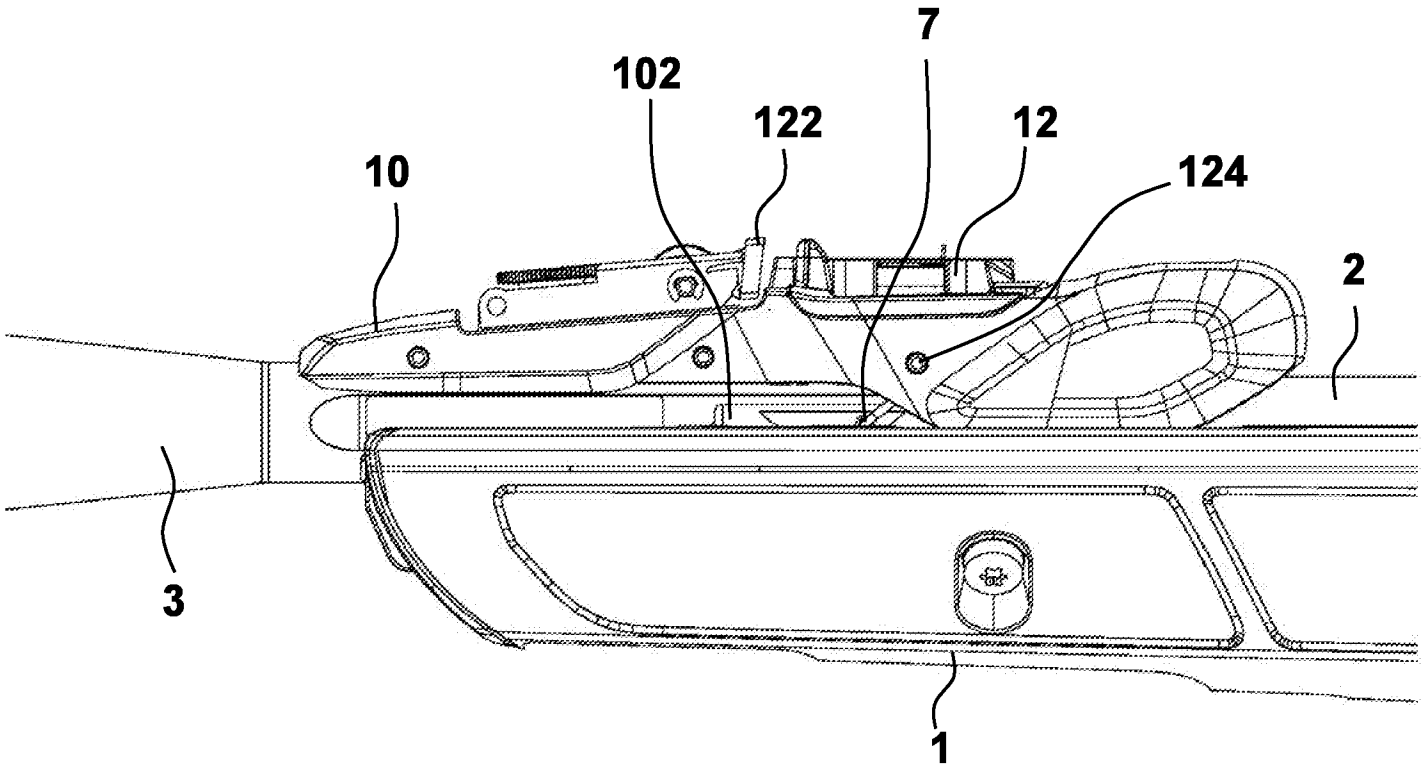
FIG. 1 is a side view of a sporting rifle, in the area of the barrel hinge, with the closed barrel object of this invention with a structure.

The drawings illustrate a few exemplary embodiments of the present inventive concept, and are not to be considered limiting in its scope, as the overall inventive concept may admit to other equally effective embodiments. The elements and features shown in the drawings are to scale and attempt to clearly illustrate the principles of exemplary embodiments of the present inventive concept. In the drawings, reference numerals designate like or corresponding, but not necessarily identical, elements throughout the several views.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout.

The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" can be used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein have to be defined based on the meaning of the terms together with the description throughout the specification.

Also, when a part "includes" or "comprises" an element, unless there is a particular description contrary thereto, the part can further include other elements, not excluding the other elements. In the following description, terms such as "unit" and "module" indicate a unit to process at least one function or operation, wherein the unit and the block may be embodied as hardware or software or embodied by combining hardware and software.

Hereinafter, one or more exemplary embodiments of the present general inventive concept will be described in detail with reference to accompanying drawings.

FIG. 1 illustrates a stock 1, a chamber 2, a barrel 3, an end 7, a body 10, a sight 122, a first rotation axis 124, a magazine 12 and a fork 102.

Figure 2:
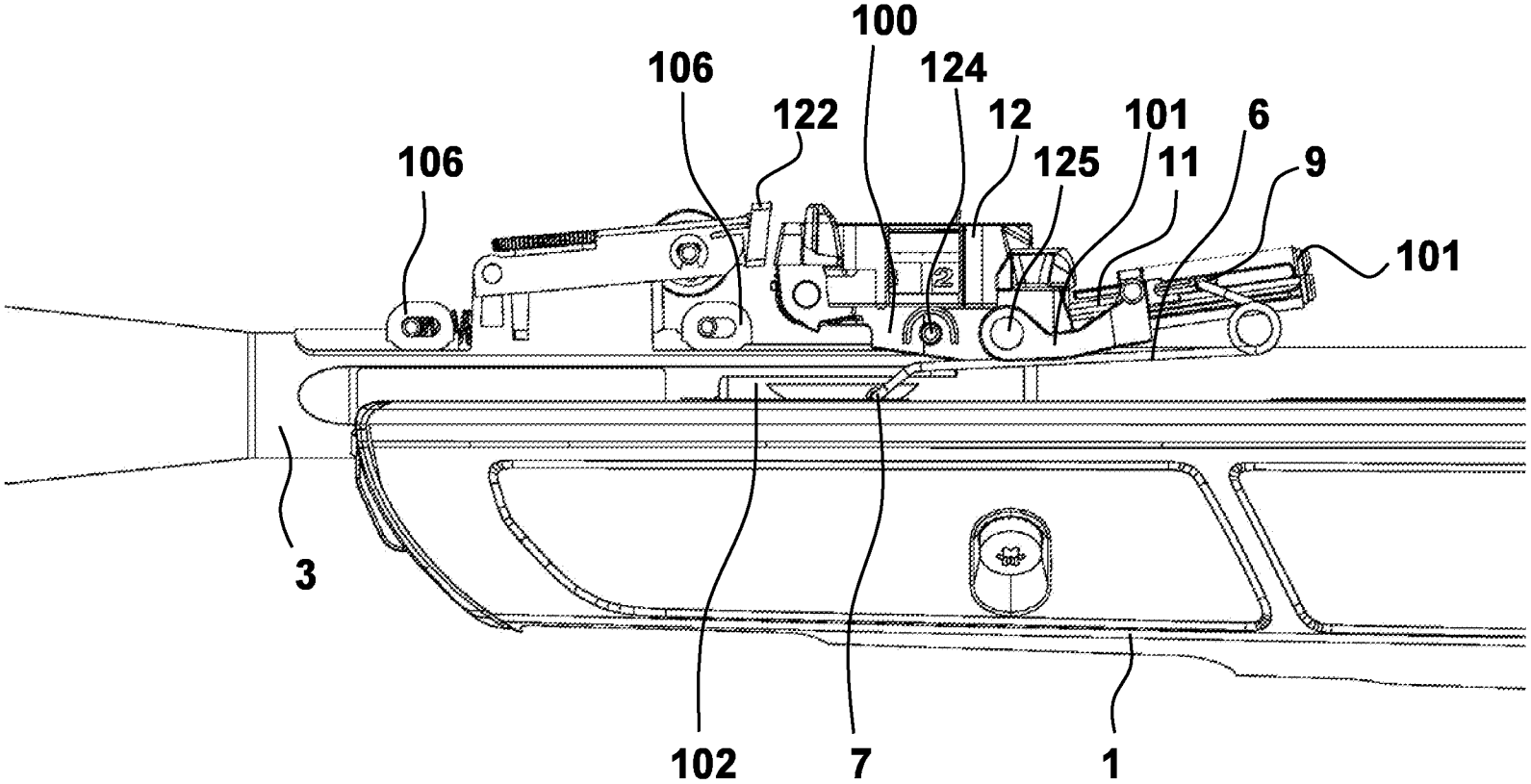
FIG. 2 is a view of FIG. 1 but without the body.

FIG. 2 represents the stock 1, the barrel 3, a first structure 6, an end 7, a central section 9, a pushing means 11, the magazine 12, a housing 100, a support 101, the first rotation axis 124, a second rotation axis 125, the fork 102 and some damping guides 106.

Figure 3A:
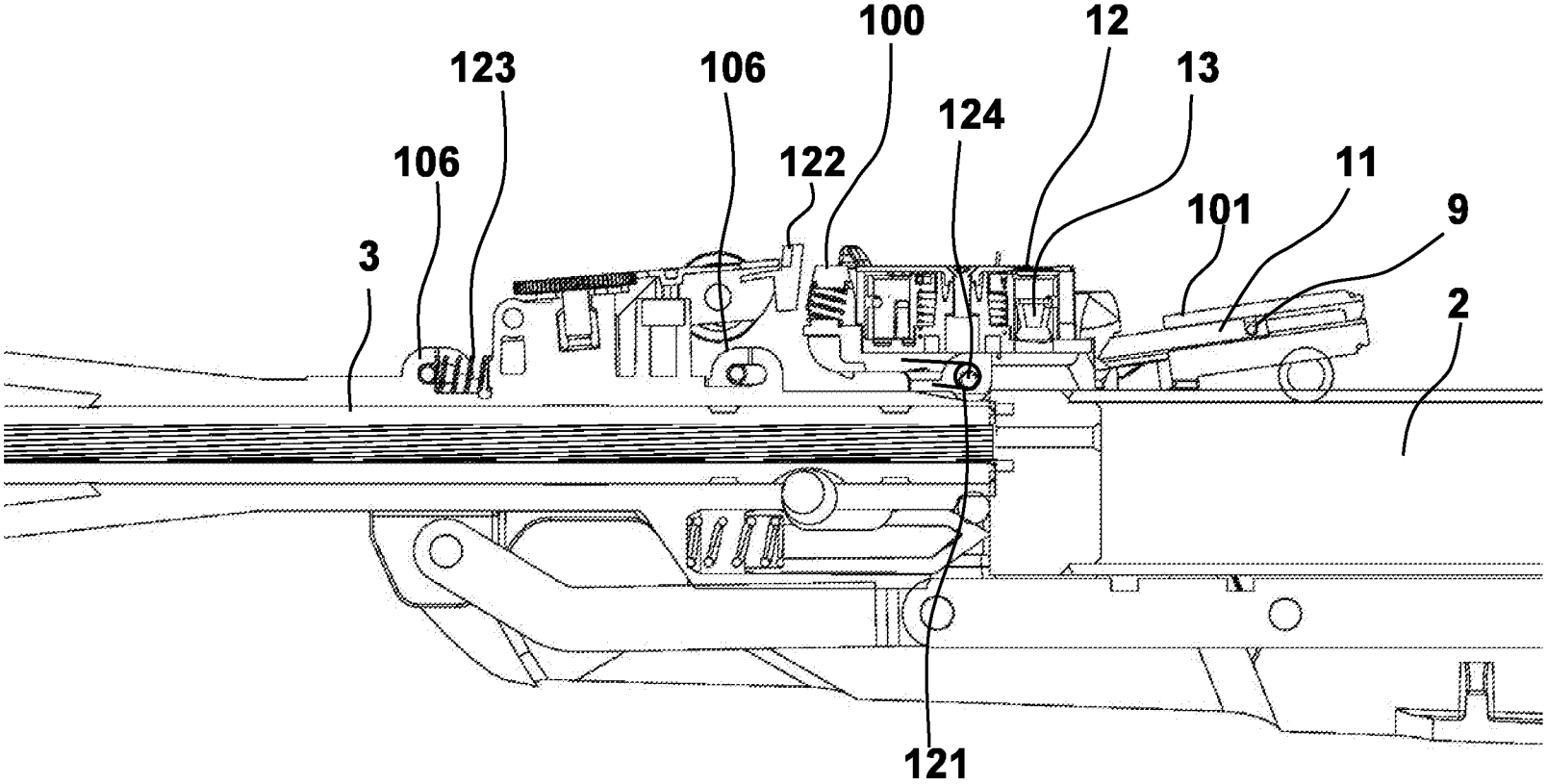
FIG. 3*a* is a sectioned view of FIG. 1, with the rifle unloaded.
Figure 3B:
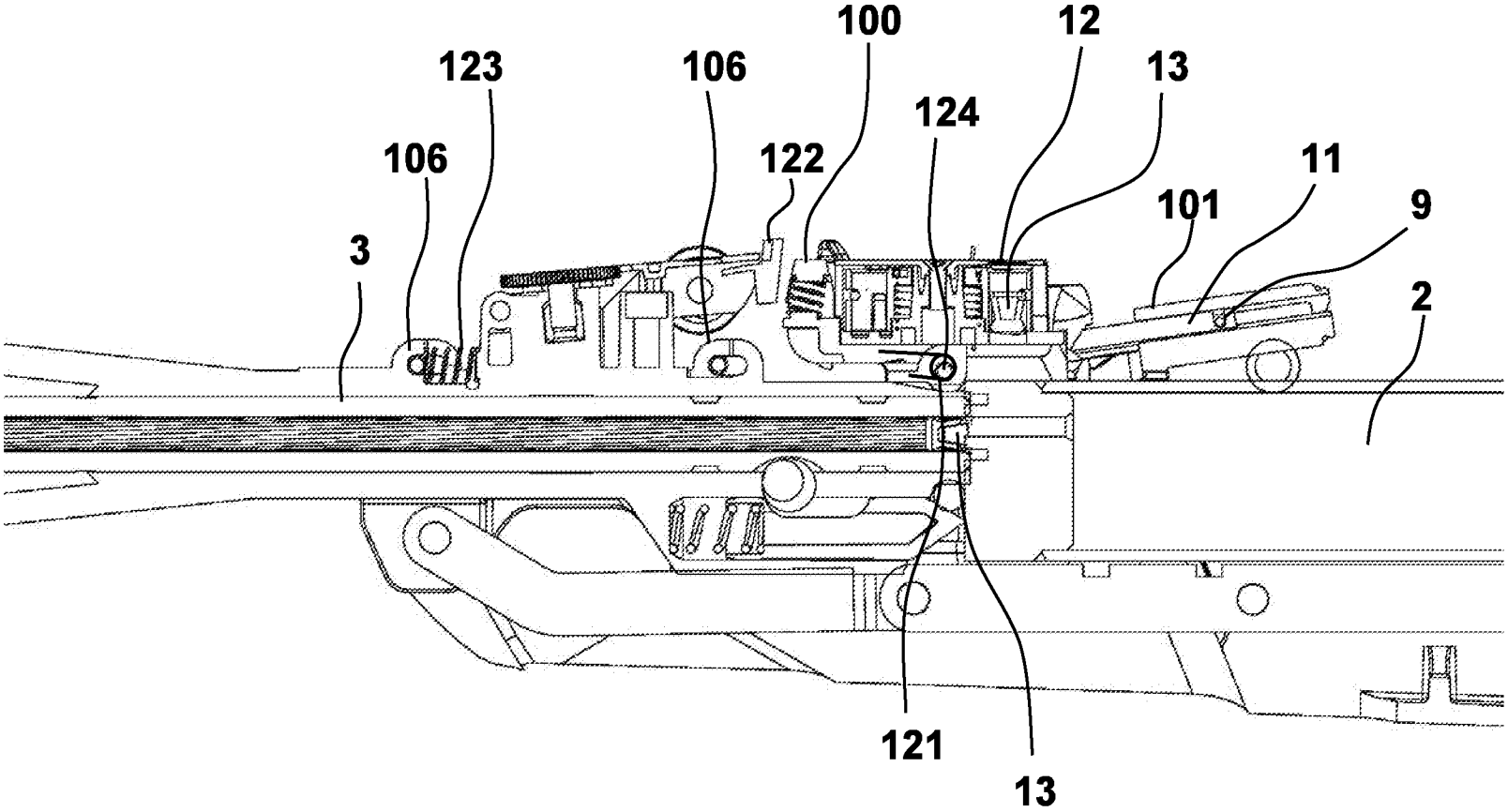
FIG. 3*b* is a sectioned view of FIG. 1, with the rifle loaded.

FIGS. 3*a* and 3*b* show the chamber 2, barrel 3, central section 9, pushing means 11, magazine 12, some pellets 13, housing 100, sight 122, first rotation axis 124, support 101, a second spring 123 and the damping guides 106.

Figure 4:
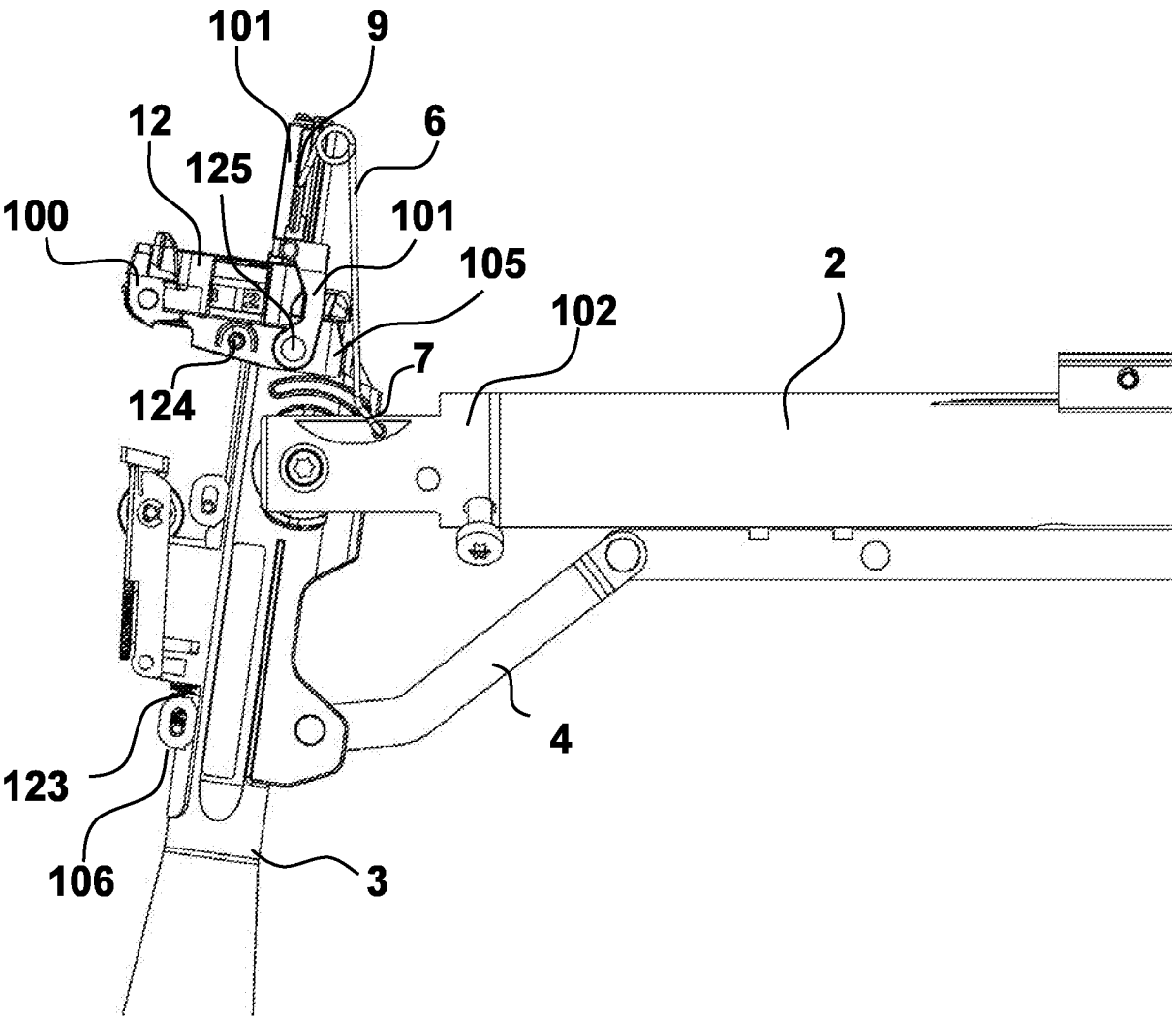
FIG. 4 is a side view of the sporting rifle, in the area of the barrel hinge, with the barrel with the collapsing movement started, but not completed, and without the body.

FIG. 4 depicts barrel 3, articulating means 4, chamber 2, the first rotation structure 6, end 7, central section 9, magazine 12, housing 100, support 101, fork 102, the first rotation axis 124, the second rotation axis 125, some end stops 105, the second spring 123 and the damping guides 106.

Figure 5:
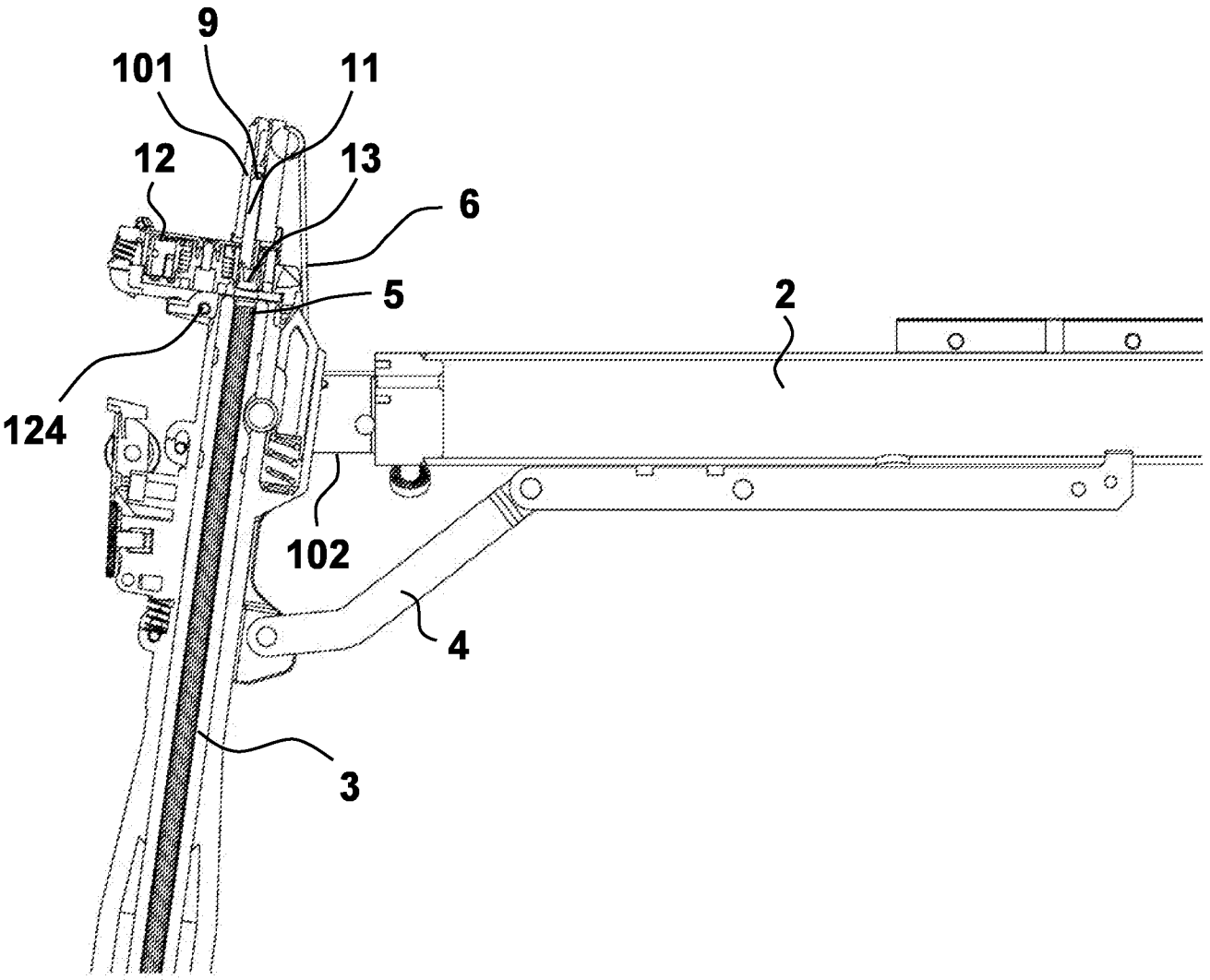
FIG. 5 is a sectioned view of FIG. 4.

FIG. 5 depicts the chamber 2, barrel 3, articulating means 4, a pellet chamber 5, first structure 6, central section 9, pushing means 11, magazine 12, pellets 13, housing 100, support 101, fork 102, first rotation axis 124, damping guides 106 and a first spring 121.

Figure 6:
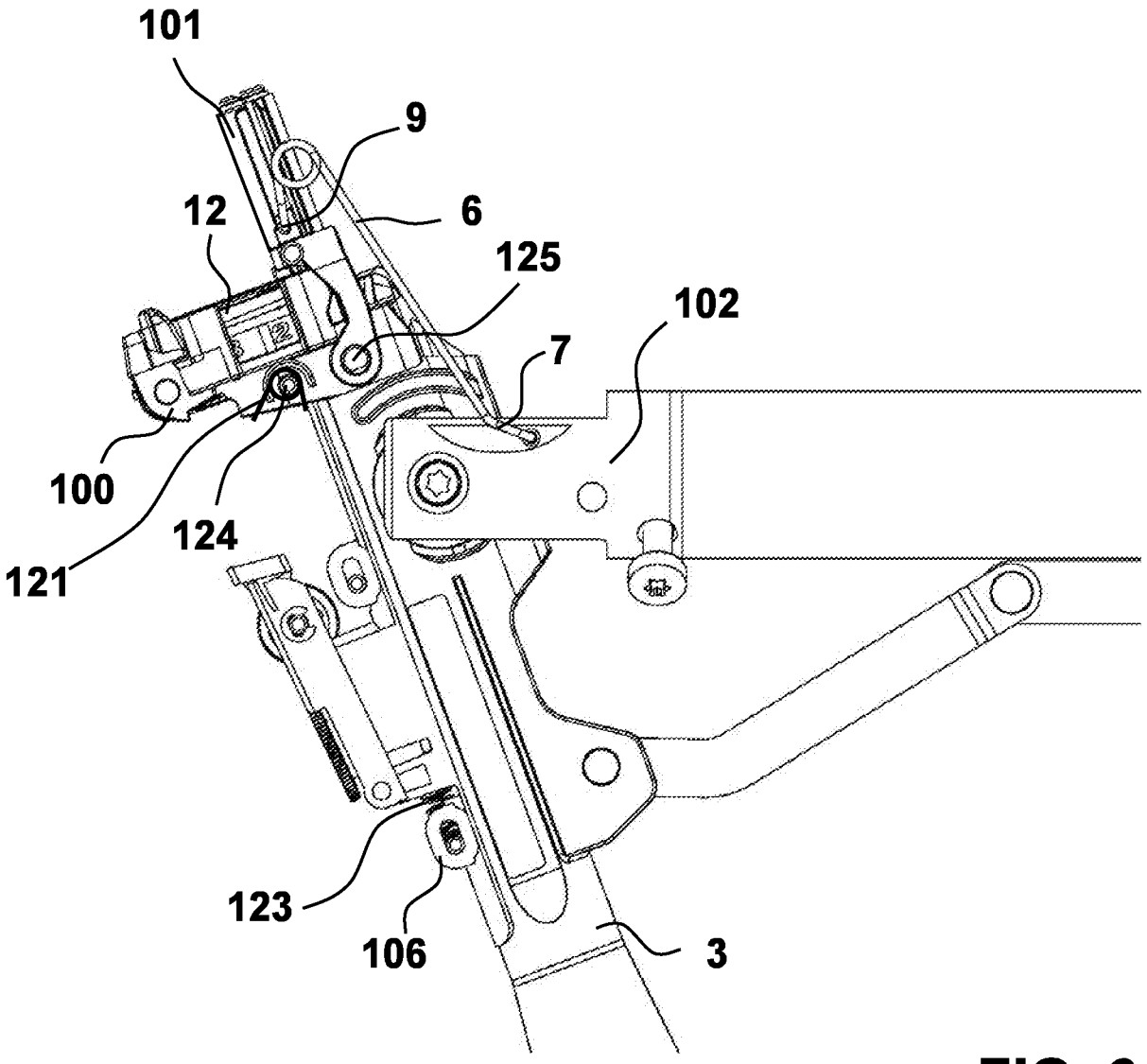
FIG. 6 is a side view of the sporting rifle, in the area of the barrel hinge, with the barrel collapsed, and without the body.

In FIG. 6 there appear the barrel 3, first structure 6, the end 7, central section 9, magazine 12, housing 100, support 101, fork 102, first rotation axis 124, second rotation axis 125, second spring 123, damping guides 106 and first spring 121.

Figure 7:
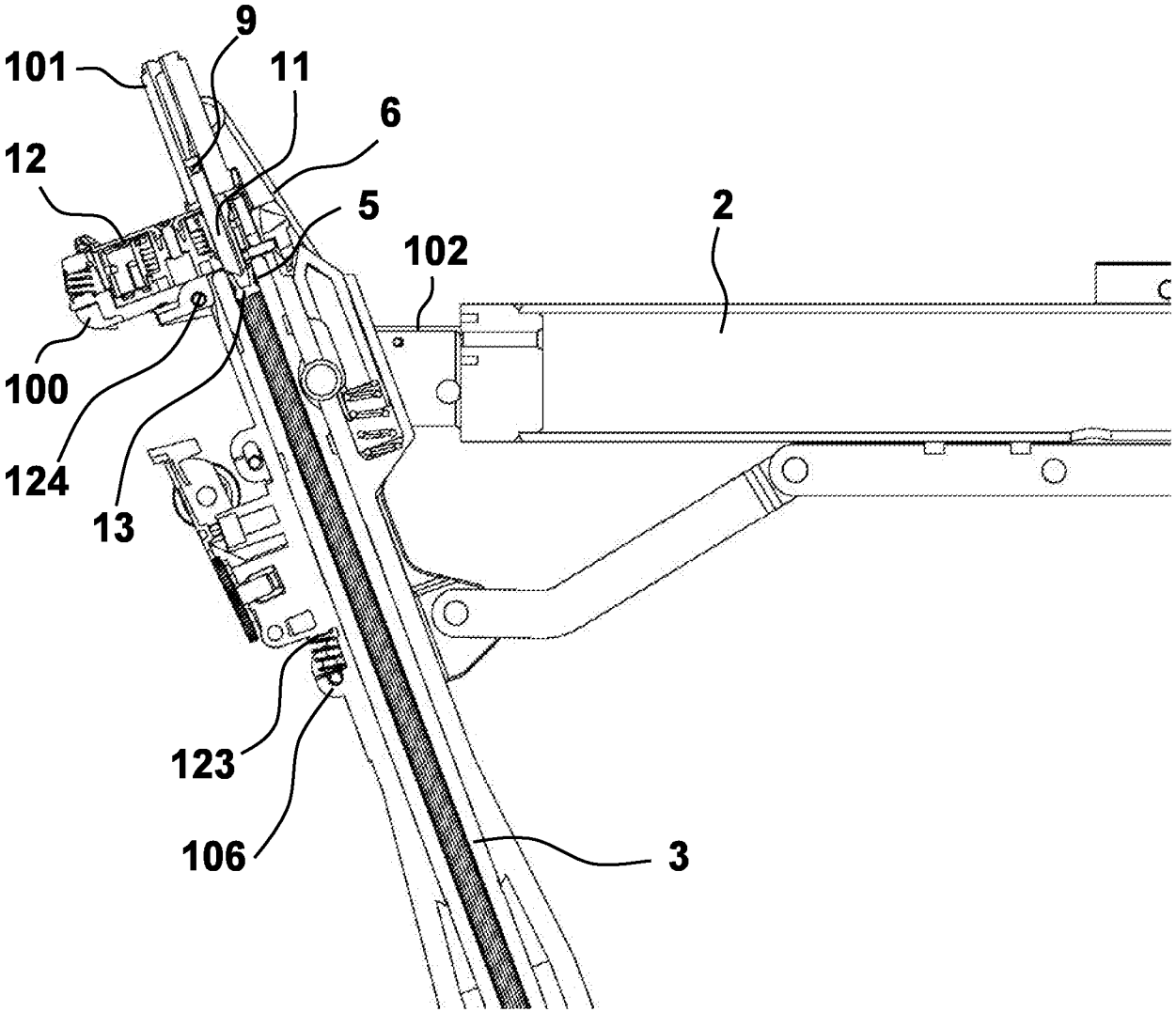
FIG. 7 is a detail, with the body partially sectioned, in the position of the collapsed barrel.

FIG. 7 shows chamber 2, barrel 3, pellet chamber 5, first structure 6, central section 9, pushing means 11, magazine 12, pellets 13, housing 100, support 101, first rotation axis 124, fork 102 and damping guides 106 with second spring 123.

Figure 8A:
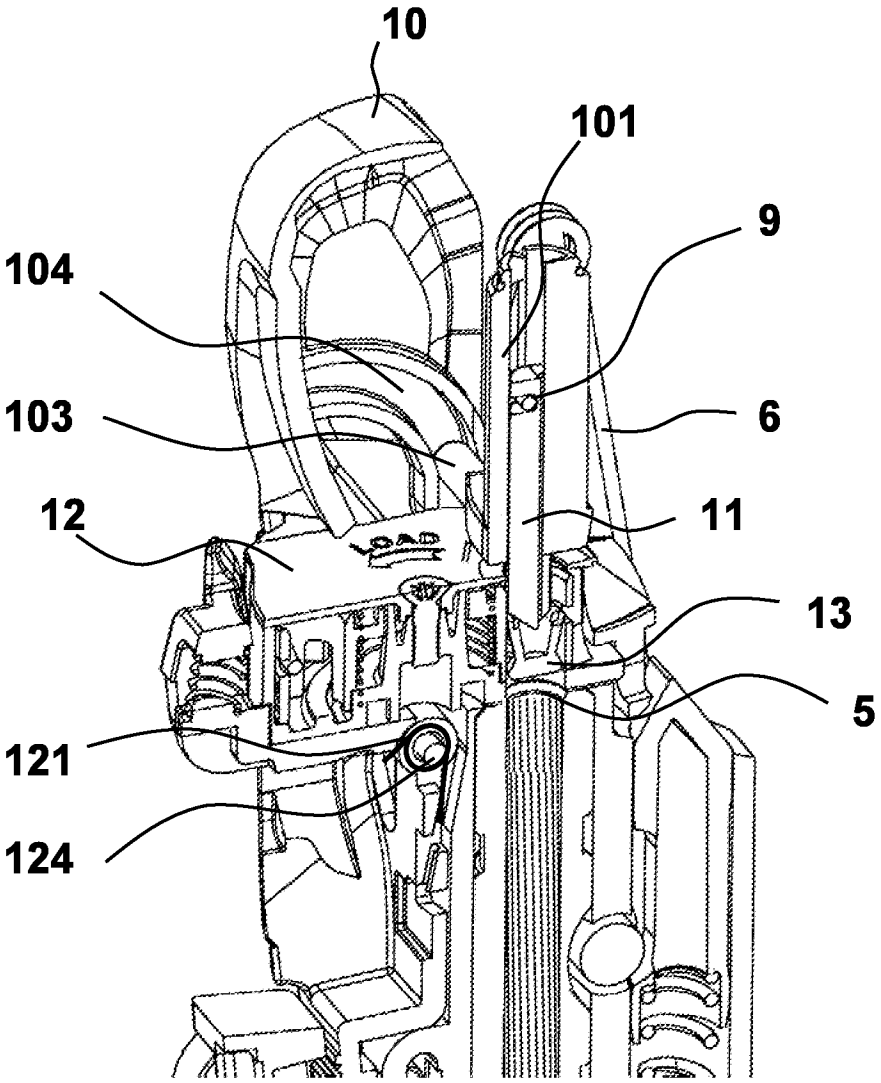
FIG. 8*a* is a partial, sectioned cut of the body with the barrel collapsed.

FIG. 8*a* represents first structure 6, central section 9, body 10, pushing means 11, the magazine 12, the pellets 13, support 101, guiding pins 103, the first rotation axis 124, guides 104 and first spring 121.

Figure 8B:
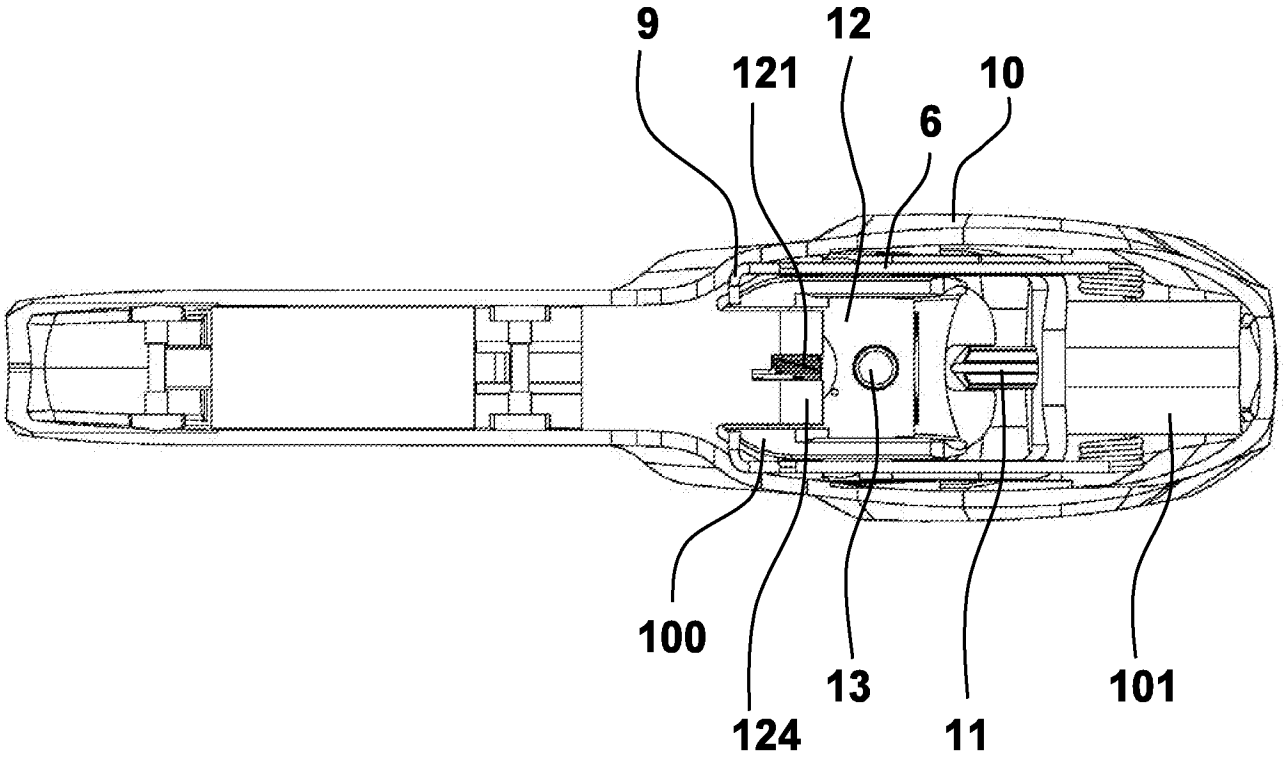
FIG. 8*b* is a lower view of the body with the barrel closed, i.e., with the magazine lying down.

FIG. 8*b* shows first structure 6, central section 9, body 10, pushing means 11, housing 100, magazine 12, pellet 13, support 101, first rotation axis 124, and first spring 121.

Figure 9:
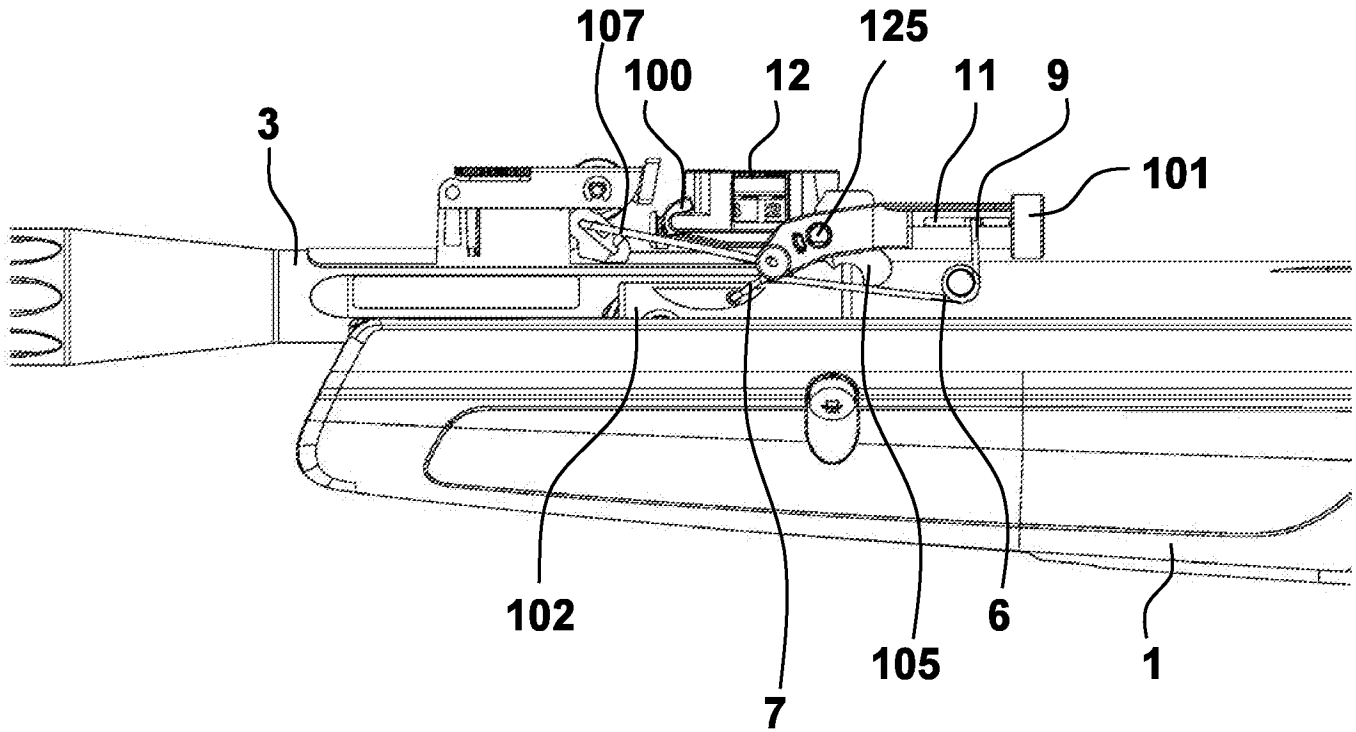
FIG. 9 is a side view of a sporting rifle, in the area of the barrel hinge, with the closed barrel object of this invention with two structures, with the body removed.

FIG. 9 depicts the stock 1, the barrel 3, first structure 6, end 7, the central section 9, pushing means 11, magazine 12, pellets 13, the housing 100, the support 101, the fork 102, the second rotation axis 125, end stops 105 and a second structure 107.

Figure 10:
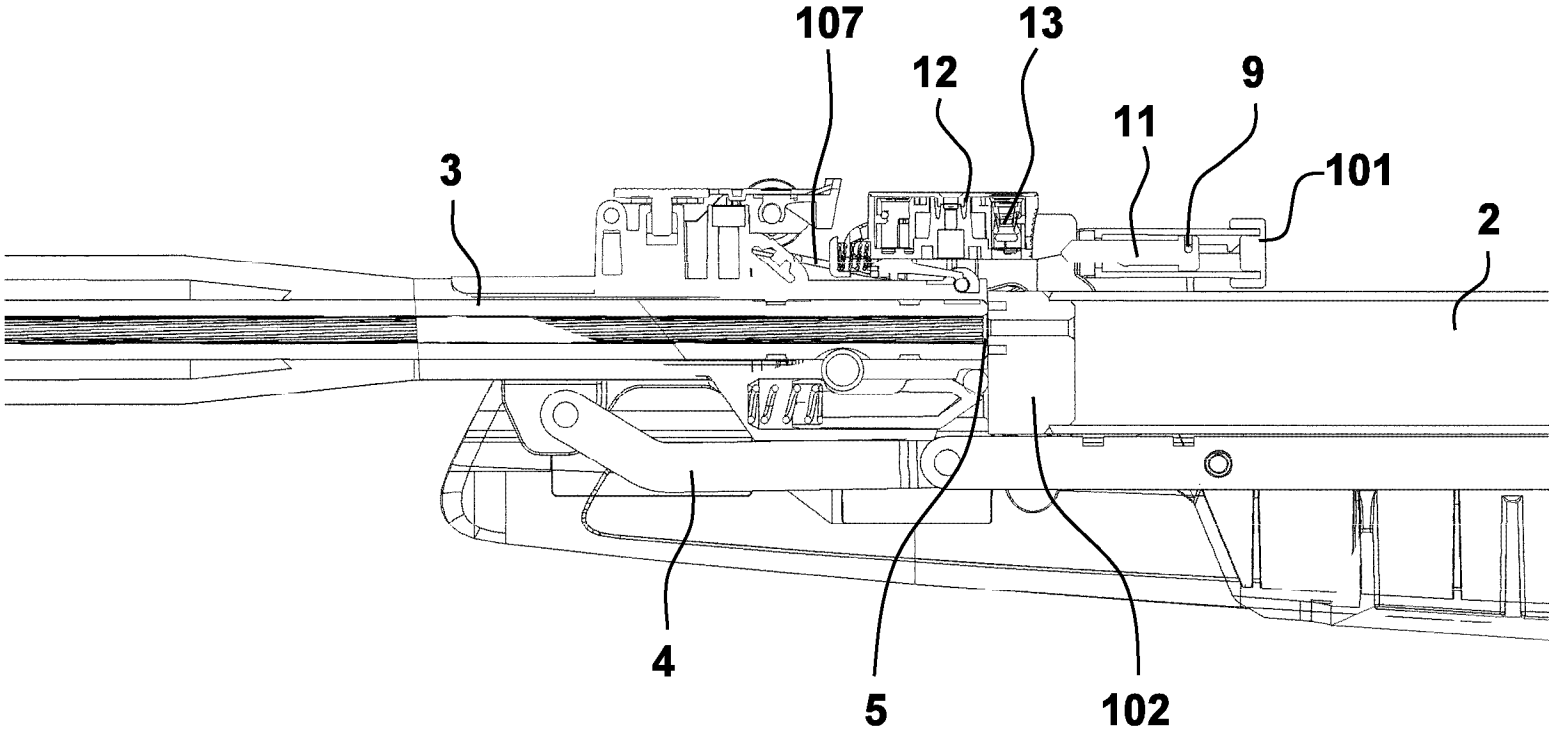
FIG. 10 is a sectioned view of FIG. 9, with the rifle unloaded.

FIG. 10 illustrates the chamber 2, the barrel 3, articulating means 4, the central section 9, pushing means 11, the magazine 12, pellets 13, the support 101, the fork 102 and second structure 107.

Figure 11:
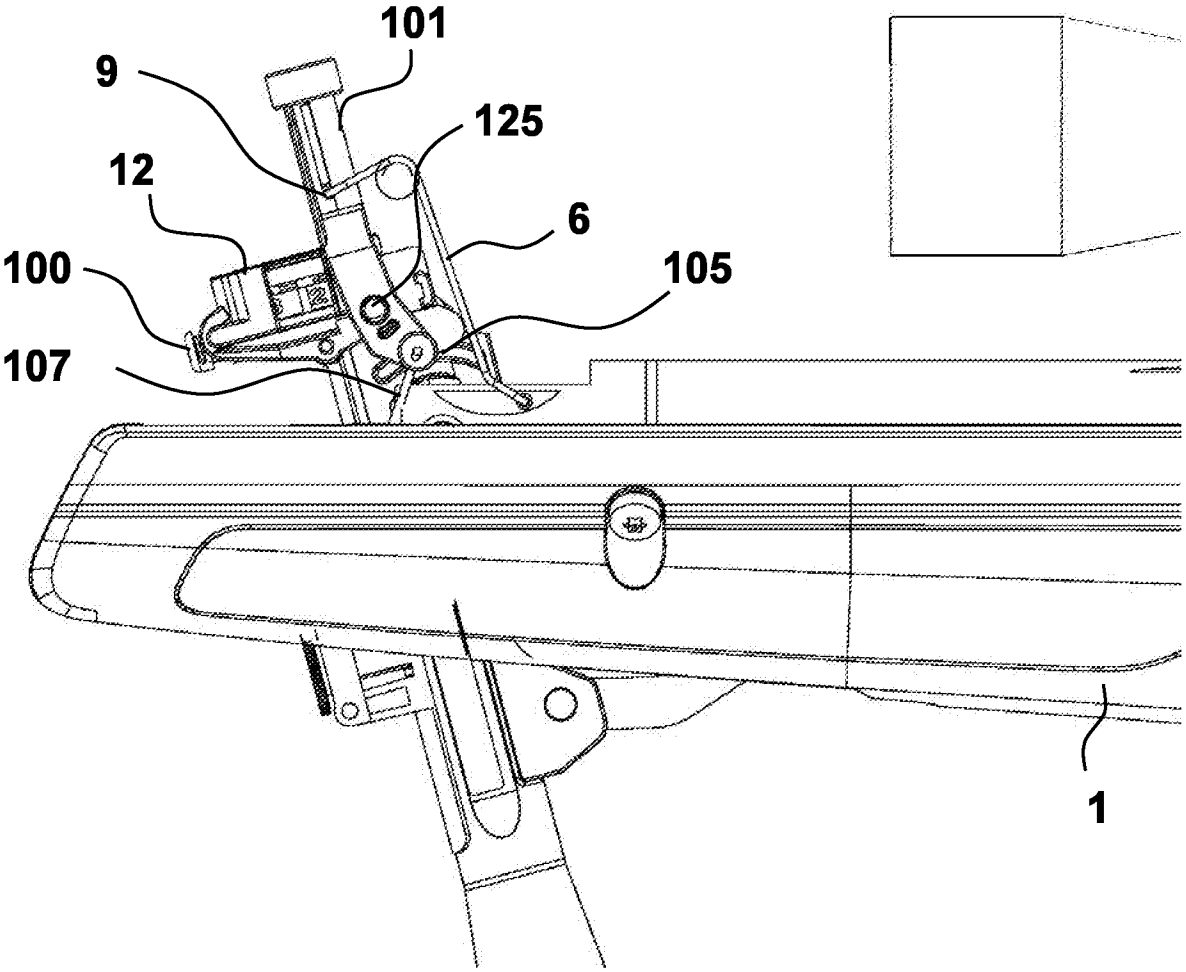
FIG. 11 is a side view of the sporting rifle with two structures in the area of the barrel hinge, with the barrel collapsed, and without the body.

FIG. 11 represents the stock 1, the first structure 6, the central section 9, pushing means 11, the magazine 12, second rotation axis 125, the housing 100, and support 101.

Figure 12:
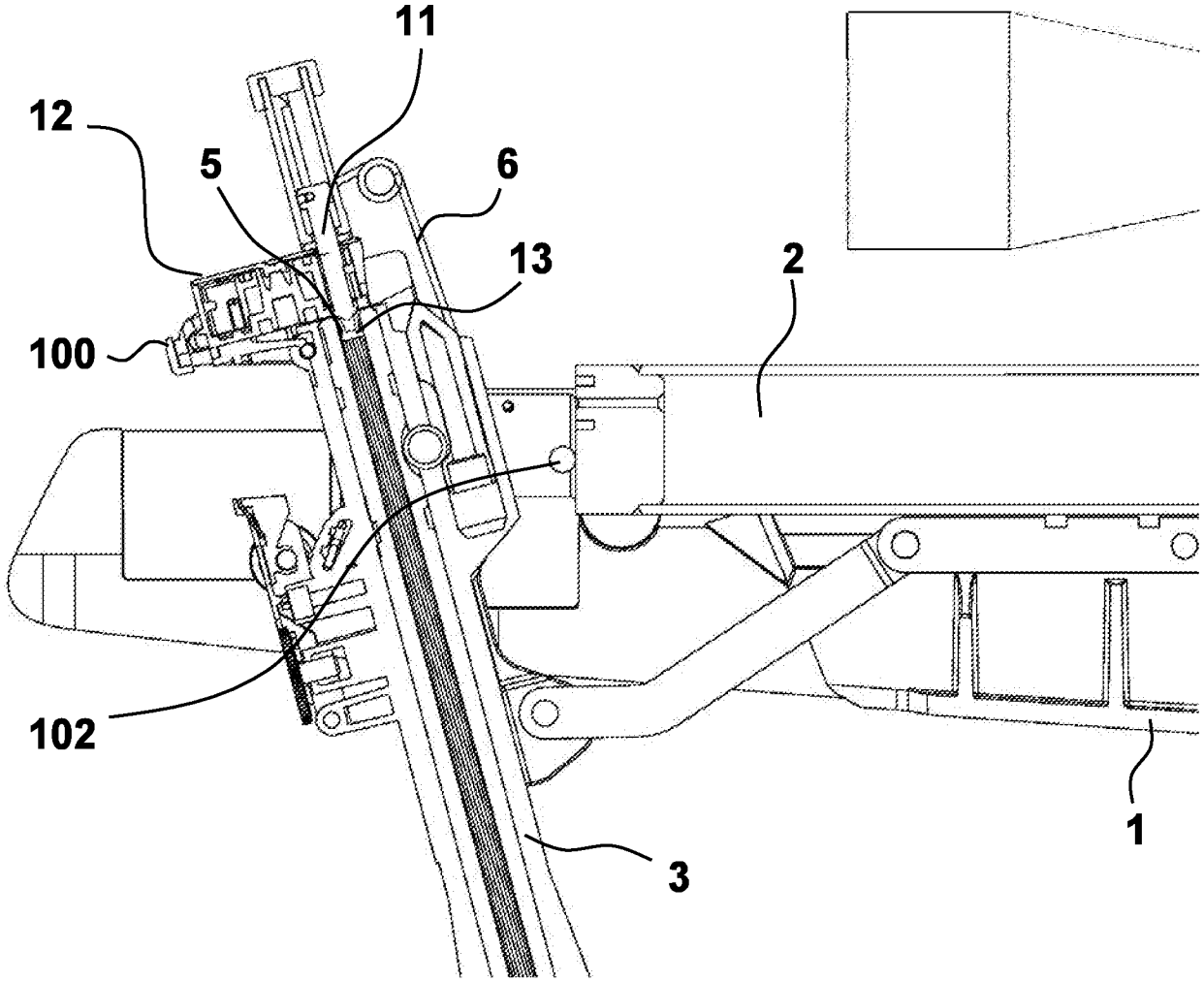
FIG. 12 is a sectioned view of FIG. 11.

FIG. 12 shows the stock 1, chamber 2, barrel 3, pellet chamber 5, first structure 6, pushing means 11, magazine 12, pellets 13, housing 100 and fork 102.

Figure 13:
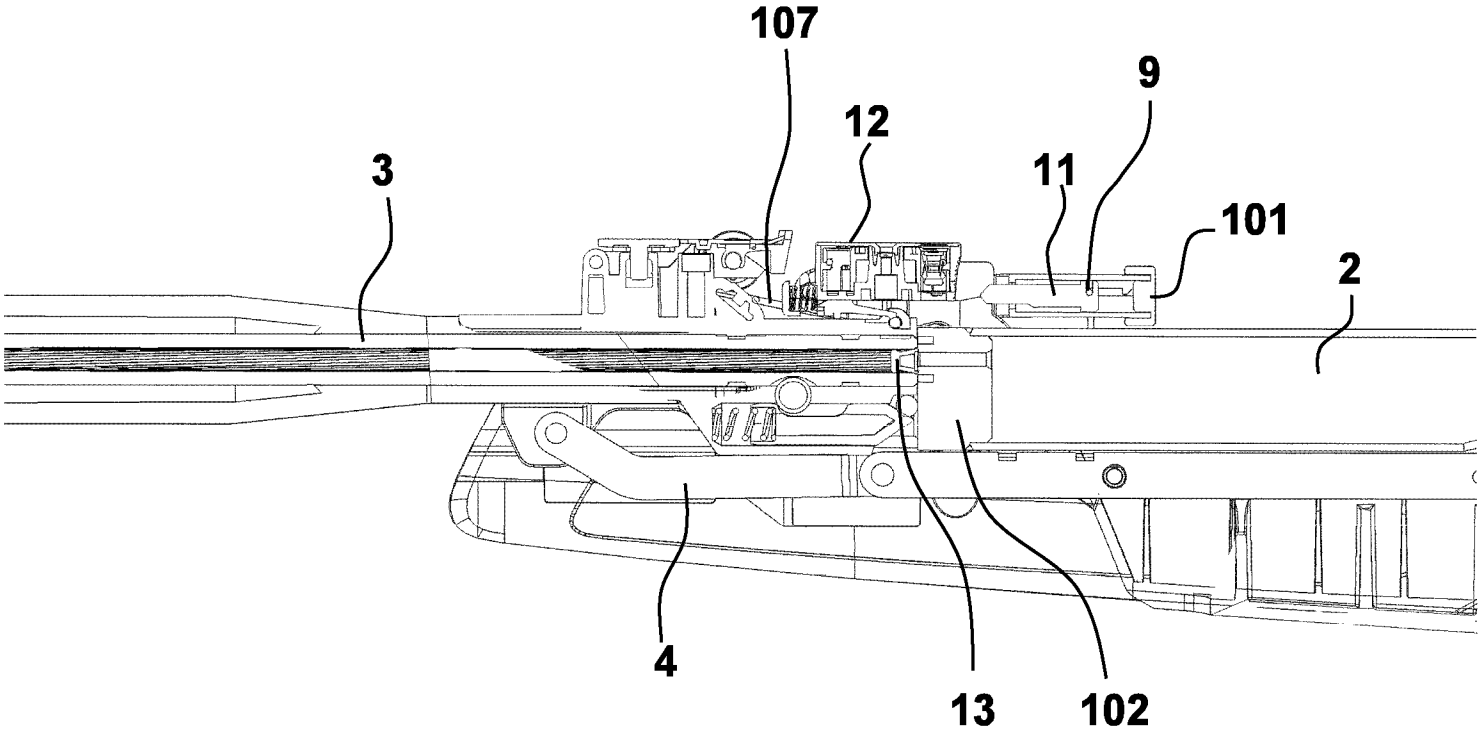
FIG. 13 is a sectioned view of FIG. 9, with the rifle loaded.

Finally, FIG. 13 illustrates the chamber 2, the barrel 3, articulating means 4, the central section 9, pushing means 11, magazine 12, pellets 13, support 101, fork 102 and second structure 107.

So, in a specific embodiment the pellet loading system, is one of those used in rifles with articulated or "break barrel" type barrels, the same type of barrel as those shown in the figures accompanying this application.

It comprises a stock 1 on which there is attached chamber 2 ending externally with a fork 102 where there is articulated a barrel thanks to articulating means 4.

On barrel 3 there is positioned pellet chamber 5, which is the place where the pellet to be fired is positioned after being removed from magazine 12 or pellets 13.

The invention comprises a first structure 6 which is configured by a central section 9 and two ends 7, 8. Said two ends 7, 8 are housed in fork 102 of chamber 2.

It has, also, a support 101 where there is positioned, at least partially, central section 9 of first structure 6. Said first structure 6 also has a forward and reverse movement, when barrel 3 collapses and closes, as will be indicated later.

A housing 100 is configured for placing magazine 12, with said housing 100 having a movement with respect to barrel 3 which means that magazine 12 can change position without moving with respect to said housing 100, as will be explained below.

The system, in its basic configuration, has a pushing means 11, linked to first structure 6, arranged on support 101. In an optional embodiment, pushing means 11 is inside support 101.

This way when barrel 3 is in the closed position, magazine 12 remains lying on barrel 3, leaving free the rear sight 122 and the firing line for the shooter.

On the other hand, when the barrel 3 collapses, the magazine 12 moves together with the housing 100 until it lies facing said magazine 12 in pellet chamber 5. This makes it easier to subsequently insert pellet 13 into magazine 12 inside pellet chamber 5.

One of the embodiment comprises the fact that when magazine 12 is facing pellet chamber 5, at the same time pushing means 11 is in front of the pellet 13 which, in turn, is in front of pellet chamber 5. This way when barrel 3 collapses, pushing means 11 is in front of pellet 13 and said pushing means 11 inserts the pellet 13 into pellet chamber 5. Pushing means 11 will return to the initial position when barrel 3 closes, with magazine 12 returning to its lying down position and leaving the rifle loaded.

Another embodiment could be that when the collapsing manoeuvre of barrel 3 finishes, pushing means 11 ends up in front of pellet 13, and subsequently, when barrel 3 closes said pushing means 11 inserts pellet 13 into pellet chamber 5, said pushing means 11 then returning to the initial position, and magazine 12 returning to its lying down position, leaving the rifle loaded.

Optionally, body 10 is articulated to barrel 3, with housing 100 for magazine 12 articulated to said body 10.

Also, in another embodiment the housing 100 for magazine 12 is articulated to the support 101 and to the body 10 although also it could be support 101 articulated to housing 100 and to body 10.

Pushing means 11, optionally could be arranged inside support 101, protected inside side support 101 as indicated above.

To facilitate the movements of support 101 and the rotation and movement of second rotation axis 125, support 101 comprises guiding pins 103 which are positioned on some guides 104, belonging to body 10 along which they move.

In order to improve the return of magazine 12 progressively to the lying down position, housing 100 of magazine 12 can comprise some end stops 105 that act in the return movement on the outside of chamber 2 and which then guide the position changing movement of magazine 12.

The body 10, in order to increase its tolerance and facilitate the guiding movements, comprises damping means on body 10.

Said damping means comprise at least an axis with a second spring 123 (in this embodiment there are two of them) and damping guides 106. This way the body 10 has certain linear movement, to-and-fro, in the same direction as the shot, and this is absorbed by the second spring 123.

So, also it can have a second structure 107 which is connected to support 101 and to the barrel 10, leaving therefore said second structure 107 coordinated to first structure 6.

One of the manufacturing options is first structure 6 or second structure 107, or both of them, as a rod.

It has been found that as rod 107 is elastic this allows saving on the manufacturing costs, and also allows some greater tolerances, although they could be rigid.

This way, when the sporting rifle, also known as "air rifle", has just fired, said rifle remains as shown in FIGS. 3*a* and 10, i.e., without a pellet 13 in pellet chamber 5.

The rifle does not need pellet 13 to be inserted manually by the sportsman, instead it has a magazine 12 which stores different pellets 13 which are loaded in pellet chamber 5 during the collapsing movements of barrel 3 and the closure thereof.

To load the pellet 13 from the magazine 12, the sportsman will break the barrel 3, as shown in FIG. 4 so that barrel 3 moves towards the perpendicular, in relation to chamber 2.

This means that magazine 12 moves from a lying down position (FIG. 1-3*b*) to a position wherein it lies facing the pellet chamber. In other words, as the barrel breaks, the magazine also moves (FIG. 4-7).

When barrel 3 closes, magazine 12 moves from the position in front of pellet chamber 5 to lie down again and not interfere in the vision between the sight 122 and the firing line.

In order to carry out said operations the rifle comprises a first structure 6 with a central section 9 and two ends 7, 8 which are housed in the fork 102 or the chamber 2.

The first structure 6, when barrel 3 breaks, rotates with respect to the fork 102 at the ends thereof 7 and at the same time its central section 9 pushes the pushing means 11 which is found on support 101, approaching it towards pellet chamber 5 due to the fact that the rotation radius of first structure 6 is shortened and this means that central section 9 pushes pushing means 11.

At the same time housing 100 which transports magazine 12 also starts a rotation movement, until magazine 12 ends up in front of pellet chamber 5.

In this embodiment the rotation is made by means of first rotation axis 124 and second rotation axis 125 which are coordinated, so that when one rotates in one direction the other one rotates in the opposite direction, which facilitates it being a controlled movement.

So, while the housing 100 with the magazine 12 move the movement to place themselves in front of pellet chamber 5, the support 101 with pushing means 11 make another movement to end up in front of the pellet 13 in the magazine 12 which has to be inserted into pellet chamber 5.

In one of the embodiment options when barrel 3 collapses completely, the pushing means pushes pellet 13 inside pellet chamber 5. Another possibility could be that when the manoeuvre for closing barrel 3 starts is when pushing means 11 inserts it or it could be before barrel 3 collapses completely.

In order to make the rotation movement with first rotation axis 124, a first spring 121 has been configured, whereby while barrel 3 is closed said first spring 121 is compressed, and when barrel 3 collapses said first spring 121 is released facilitating the rotation movement of magazine 12.

When the barrel 3 closes, first spring 121 is compressed and at the same time end stops 105 of body 10 rest on the chamber 2, this prevents the system from closing abruptly, unbalancing the various elements.

There are damping means for body 10, made up of damping guides 106 and second spring 123 which allow a to-and-fro movement of body 10, facilitating its positioning in the manoeuvres for collapsing and closing the barrel.

The housing 100 can adopt different configurations to secure the magazine 12 to the housing 100, such as for example a blocking mechanism for magazine 12 similar to a ski binding system, which would allow securing magazine 12 in the above-mentioned movements.

As shown in FIG. 8*a*, in order to facilitate the breaking and closing manoeuvres of barrel 3, the arrangement of guides 104 has been envisaged inside body 10 which guiding pins 103 run along that are integral to support 101, so that support 101 would have a controlled movement synchronized with that of body 10.

The second rotation axis 125 is connected to the support 101, and it is the one that articulates said support 101 and pushing means 11 as a result of the force applied on said pushing mean 11 by central section 9 of first structure 6.

When ends 7 of first structure 6 rotate in fork 102, said second rotation axis 125 allows support 101 to be placed correctly and consequently pushing means 11 would also be placed correctly when barrel 3 collapses; so, both would be placed correctly when the closing movement of barrel 3 occurs.

In another embodiment, as shown in FIGS. 9 to 13, the damping means are replaced by a second structure 107, which attaches to support 101 and to a fixed element of barrel 3, for example, the sight 122, creating the same effect of the manoeuvre explained above.

Said first structure 6 in the two embodiments and second structure 107, can adopt different configurations, as elastic rods, or rigid structures like splints.

This patent of invention describes a new pellet loading system. The examples mentioned herein are non-limiting of this invention, therefore it could have different applications and/or adaptations, all within the scope of the following claims.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A system for loading pellets, the system comprising:

a stock including a chamber fixed thereon, the chamber having a fork at one end thereof where a barrel is articulated; and a break barrel type barrel including an articulating means, a pellet chamber, a magazine of pellets laid on the barrel and facing the pellet chamber, a first structure with a central section and two ends which are housed in the fork of the chamber, a support member to support the central section of the first structure to be moveable in both forward and reverse directions, a housing in which the magazine is disposed, and a pushing means linked to the first structure (6) and arranged on the support member;

wherein when the barrel is articulated to a break trajectory position with the chamber and then articulated back to an alignment position with the chamber the pushing means pushes a pellet from the magazine into the pellet chamber.

2. The system according to claim 1, wherein when the magazine is positioned in front of pellet chamber the pushing means becomes positioned in front of a pellet which, in turn, becomes positioned in front of the pellet chamber such that during the break movement of barrel the pushing means is in front of a pellet and inserts the pellet into pellet chamber.

3. The system according to claim 2, further comprising:

a body articulated to the barrel, wherein the housing for the magazine is articulated to the body.

4. The system according to claim 2, wherein the support member is articulated to the housing and to the body.

5. The system according to claim 2, wherein at least one of the first structure and the second structure is a rod.

6. The system according to claim 1, wherein at the end of the breaking operation of the barrel, the pushing means is positioned in front of the pellet, and at a moment when the barrel is closing, the pushing means inserts the pellet into the pellet chamber, with the pushing means then returning to the initial position.

7. The system according to claim 6, further comprising:

a body articulated to the barrel, and wherein the housing for the magazine is articulated to the body.

8. The system according to claim 6, wherein the support member is articulated to housing (100) and to body (10).

9. The system according to claim 6, wherein at least one of the first structure and the second structure is a rod.

10. The system according to claim 1, further comprising:

a body articulated to the barrel, wherein the housing for the magazine is articulated to the body.

11. The system according to claim 10 wherein the housing for the magazine is articulated to the support member and to the body.

12. The system according to claim 11, further comprising: pushing means located inside the support member to push a pellet into the pellet chamber.

13. The system according to claim 12, wherein the support member comprises guiding pins which are positioned on guides of the body along which the guide pins move.

14. The system according to claim 13, wherein the housing of the magazine comprises stops positioned outside of the chamber that guide the position changing movement of the magazine.

15. The system according to claim 11, further comprising damping means in the body.

16. The system according to claim 15, wherein the damping means comprise an axis with a second spring and damping guides.

17. The system according to claim 1, further comprising: a second structure connected to the support member and to the body and coordinated with the first structure.

18. The system according to claim 17, wherein at least one of the first structure and the second structure is a rod.

19. The system according to claim 1, wherein at least one of the first structure and the second structure is a rod.

20. The system according to claim 19, wherein the rod is elastic.

* * * * *